US005305472A

United States Patent [19]

Eger

[11] Patent Number: 5,305,472

[45] Date of Patent: Apr. 26, 1994

[54] VENTILATION UNIT FOR A TOILET

[76] Inventor: Leroy O. Eger, 401 E. Robinson St., #105, Orlando, Fla. 32801

[21] Appl. No.: 14,844

[22] Filed: Feb. 8, 1993

[51] Int. Cl.[5] ..... E03D 9/052

[52] U.S. Cl. ..... 4/213; 4/216; 4/347; 4/349

[58] Field of Search ..... 4/211, 213, 216, 349, 4/352, 347

[56] References Cited

U.S. PATENT DOCUMENTS

| | | | |
|---|---|---|---|
| 2,190,068 | 2/1940 | Henschler | 4/213 |
| 3,192,539 | 7/1965 | Martz | 4/213 |
| 3,939,506 | 2/1976 | Pearson | 4/213 |
| 4,007,498 | 2/1977 | Pearson | 4/213 |
| 4,017,916 | 4/1977 | Pearson | 4/213 |
| 4,232,406 | 11/1980 | Beeghly et al. | 4/213 |
| 5,029,346 | 7/1991 | Fernald, Sr. | 4/216 |
| 5,054,130 | 10/1991 | Wilson | 4/213 |

FOREIGN PATENT DOCUMENTS

| | | | |
|---|---|---|---|
| 493200 | 10/1938 | United Kingdom | 4/213 |

*Primary Examiner*—Henry J. Recla
*Assistant Examiner*—Charles R. Eloshway
*Attorney, Agent, or Firm*—Robert L. Wolter; Robert W. Duckworth

[57] ABSTRACT

A toilet ventilation unit including a vacuum motor mounted in the wall voids surrounding the toilet that is connected to the back of the tank and utilizes the water passageway of a conventional toilet to draw odors and aromas from the toilet. A vacuum shut off valve is mounted adjacent the back of the tank and is actuated concomitantly with the rising and lowering of the water level to cut off the air flow from the toilet. An additional valve is also mounted adjacent the tank to act in opposition to the shut-off valve and provide relief from the vacuum created from the drop of the water level during flushing. A release valve is adjacent the vacuum motor to draw air from an air source alternative to the toilet, when the shut-off valve is activated.

10 Claims, 5 Drawing Sheets

VENTILATION UNIT FOR A TOILET

FIELD OF INVENTION

The present invention relates generally to the field of toilets, and particularly with respect to those devices used as ventilation systems for toilets.

BACKGROUND OF THE INVENTION

Ridding a bathroom of the unpleasant odors and aromas associated with a toilet may be solved by using chemical type deodorizers that are often perfumed and injected into the water of the toilet. However, these are often short lived and may otherwise not adequately solve the problem of deodorizing odors in a bathroom.

Additionally, toilets have been adapted or modified to include means to draw odors from the toilet where such odors are further exhausted or deodorized. At least one invention, U.S. Pat. No. 4,153,956 uses a device to draw the odors through the water passages present in a conventional toilet having a water tank and bowl. Unfortunately, this invention requires significant modification or adaptation to the lid of the water tank of a toilet. Moreover, the actual deodorizing device is visible. Other devices known in the art require additional significant adaptations that may not be readily and economically incorporated into conventional toilets and building constructions.

SUMMARY OF THE INVENTION

It is an object of the present invention to provide a ventilation unit for a toilet that induces an air flow through the water passage of a conventional toilet bowl, and direct the odors and aromas out of the toilet to wall voids or piping surrounding the toilet. Still another object is to provide a means for automatically adjusting the air flow concomitantly with the water level of the water in the water tank of the toilet.

Yet another principle of this invention is to provide a ventilation unit that is cost effective and easily adaptable to conventional toilets and building construction. Still another object is to provide a ventilation unit that is not visible, and relatively noise-free during operation.

These and other objects, advantages and features of my invention are advantageously accomplished in a unique toilet ventilating system. The ventilation system is used with a conventional toilet having a bowl with a water tank. In the conventional toilets a water passageway is available in the rim of the bowl, extends into the tank and is integral with a vertical water overflow tube mounted in the tank. My system utilizes this water flow system as an air flow passageway to remove aromas from the toilet bowl and tank.

My invention includes an air drawing or inducing means that is connected to the back of the tank at a point somewhere above the water line of the tank. The air induction means may include a vacuum motor and is preferably mounted out of sight as in the wall voids or ceiling attic space near the toilet and draws air through the passageway and piping to create a vacuum suction directing air flow out of the toilet. An air flow regulating means is mounted to the ventilation system and is actuated by the lowering and raising of the water level in the toilet tank. This control means may include a shut-off valve pivotally mounted where the ventilation unit attaches to the water tank and a floating device connected to the valve acts to pivot the valve and opens or closes it as the water level rises or lowers. An additional valve may be mounted adjacent the tank that operates in opposition to the shut off valve to provide relief in the tank when the water level drops creating a vacuum in the tank.

The ventilation system is activated while the toilet is in use and draws air through the water passageways of the toilet and through the tank to the wall voids surrounding the toilet where it is exhausted through a vacuum motor. When the toilet is flushed, the floating means attached to the shut-off valve descends and rotates the valve to cut off air flow to the vacuum motor. A relief valve mounted adjacent the vacuum motor is then activated to draw air from an alternative air source to prevent the vacuum motor from burning out.

BRIEF DESCRIPTION OF THE DRAWINGS

The apparatus embodying the features of my invention is depicted in the accompanying drawings which form a portion of this disclosure and wherein.

DETAILED DESCRIPTION OF THE DRAWINGS

Figure 1:
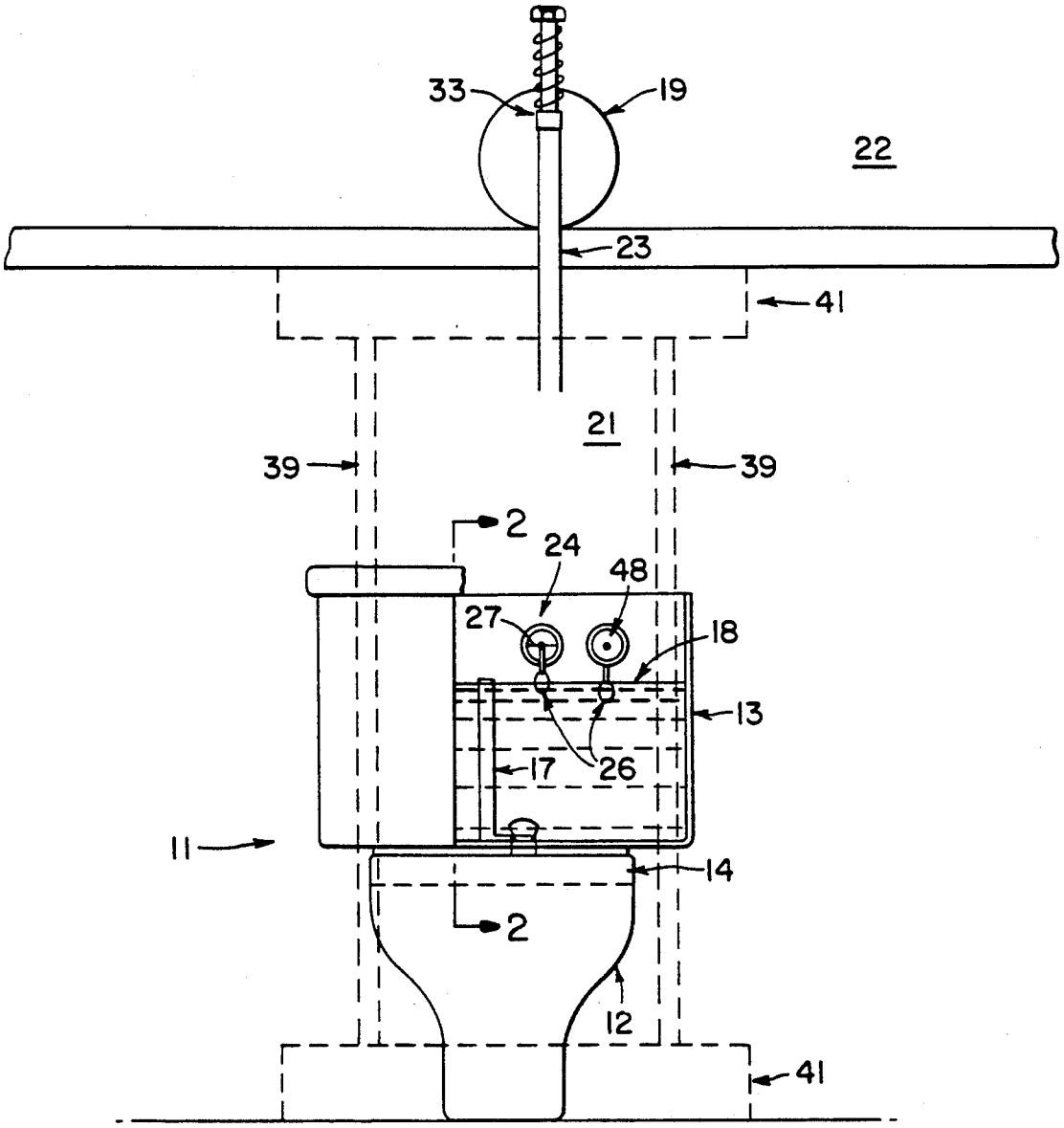
FIG. 1 is a rear elevational view of a toilet with a portion of the tank cut away.
Figure 2:
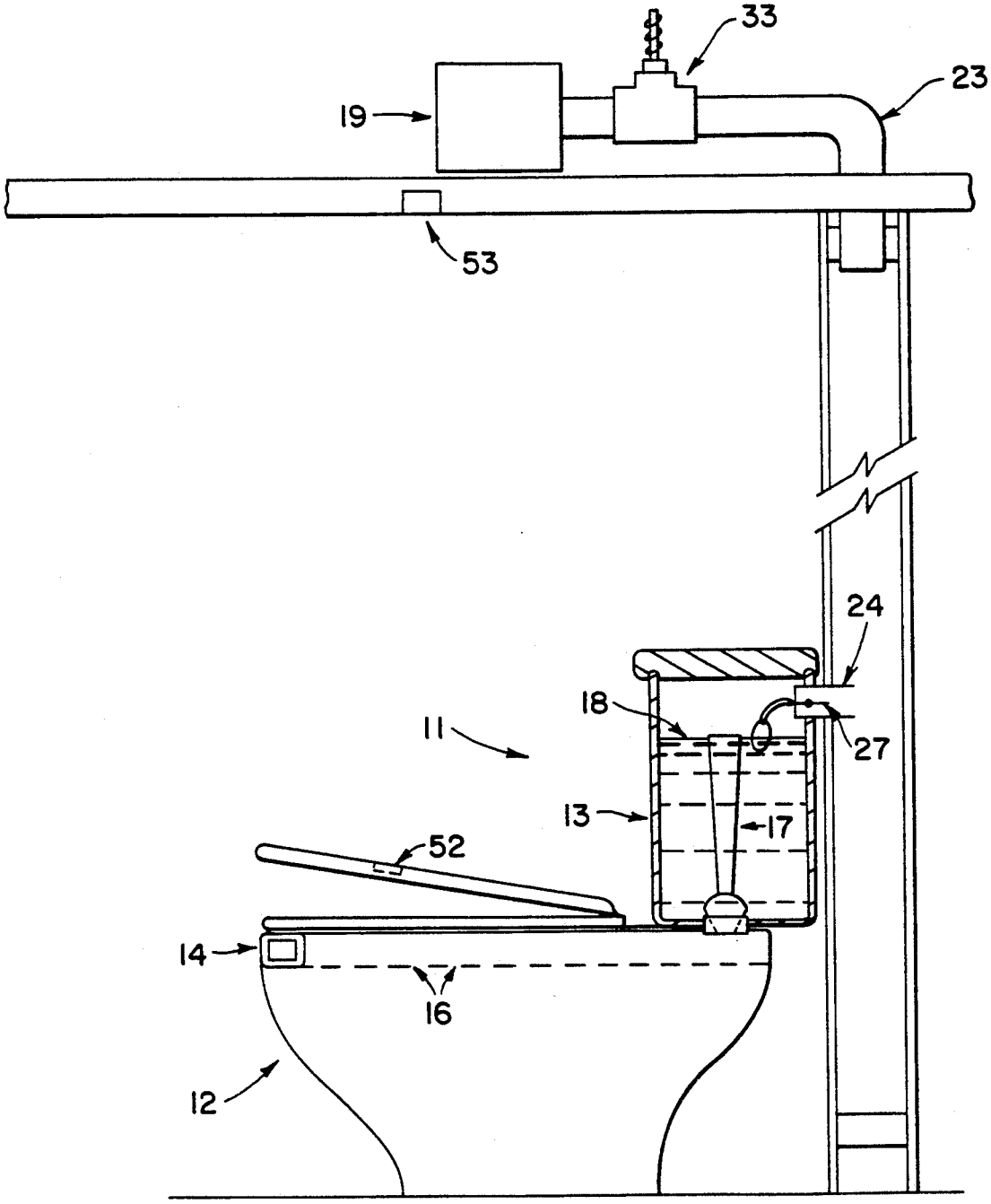
FIG. 2 is a sectional view taken along line 2—2 in FIG. 1.
Figure 7:
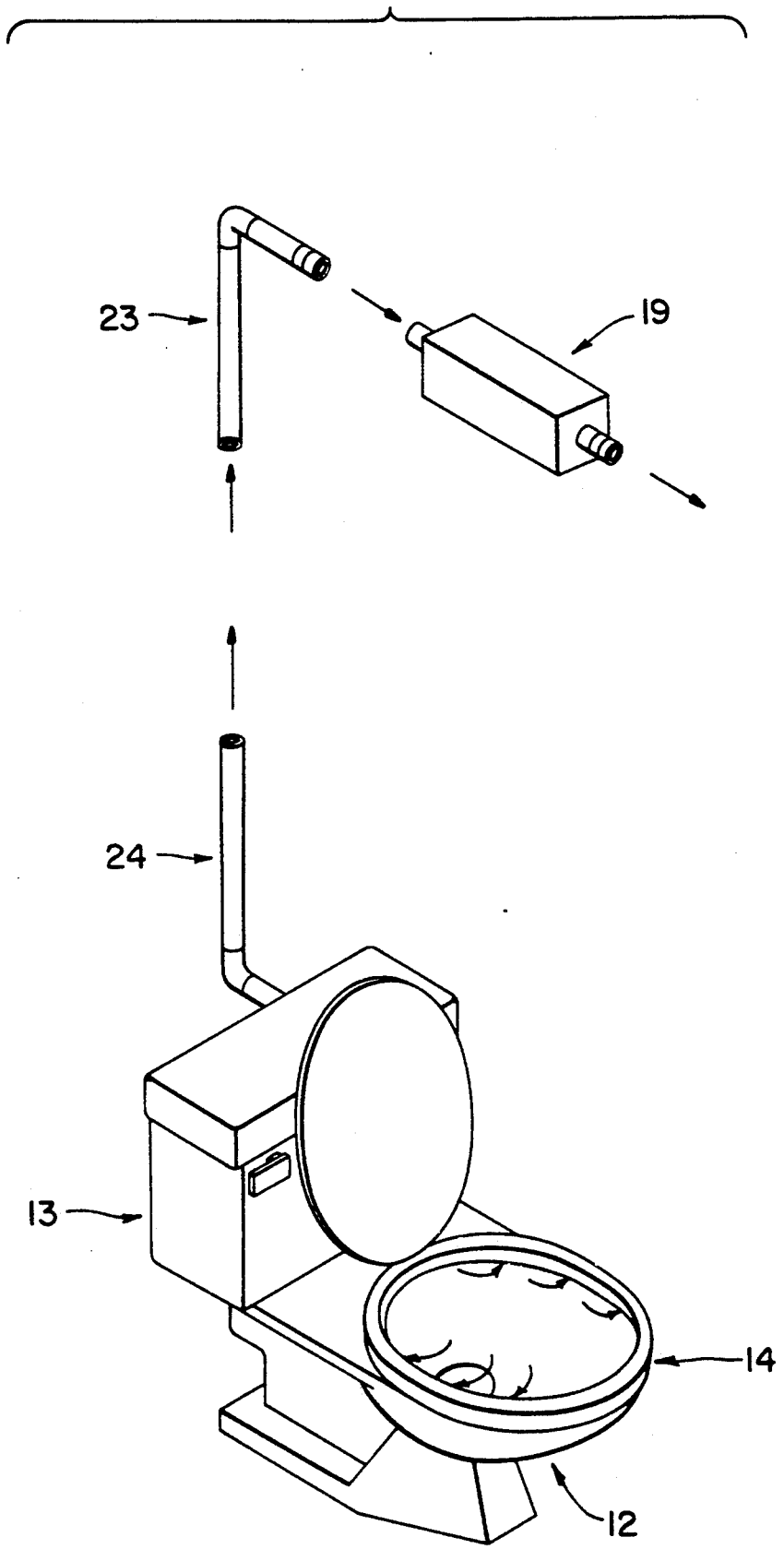
FIG. 7 is a perspective view of a toilet equipped with the ventilation unit

Referring to the drawings for a better understanding of the invention, it will be appreciated that my invention is utilized with a conventional toilet 11. These toilets include a bowl 12 with a tank 13 as illustrated in FIG. 1 and 2. A water passageway that includes a conduit 14, having water holes 16, is integral with the rim of the bowl 12. A vertical water overflow tube 17 is mounted within the water tank 13 and integral with the conduit 14. Preferably the toilet 11 is positioned against a wall having a void defined by studs 39 and horizontal frame members 41. In operation of the toilet 11, water flows from the tank 13 into the conduit 14 and out of the water holes 16 to rinse the bowl 12. My invention uses this passageway to induce air flow opposite the direction of water flow prior to flushing to draw aromas or odors from the bowl and away from the tank as illustrated in FIG. 7.

The ventilation unit includes an air induction means to facilitate the air flow away from the tank. Such air induction means may include a vacuum motor 19 connected to the water tank 13 above the water line 18. The vacuum motor 19 is preferably mounted in the wall voids 21 or attic space 22 surrounding the toilet 11, and may be electrically activated by an electrical switch or timer mounted close to the toilet 11 in the bathroom.

Another embodiment may include means for automatically activating and de-activating the vacuum motor in accordance with the movement of the toilet lid. A reflector 52 is mounted in the lid of the toilet, and a photo-relay infrared sensor 53 is mounted in the ceiling to detect light from the reflector 52. The sensor 53 is electrically connected to the vacuum motor 19 such that the vacuum motor is activated when the toilet lid is lifted for use and de-activated when the lid is lowered.

When the vacuum motor 19 is mounted in the ceiling, a conduit 23 is connected to the vacuum motor 19 and extends downward into the wall void 21 behind the toilet 11. A second conduit 24 is mounted in the back of the water tank 13 at a point above the water line 18 of the water tank 13. The conduits 23 and 24 may be interconnected to form a single conduit which extends between the vacuum motor 19 and toilet tank 13, to improve draw created by the vacuum motor and avoid potential air leaks in the wall voids. The material used for the conduits 23 and 24 may be conventional polyvinyl chloride (PVC), copper, stainless steel or any conventional piping used in plumbing construction. When the vacuum motor 19 is activated, the air flow is in reverse to the water flow through the water holes 16, conduit 14, to the overflow tube 17 and out of the tank 13 through the conduit 24. Then the air is directed up the wall void 21 through conduit 23 and into the vacuum motor 19 where it is exhausted. The size of the vacuum motor and conduit 23 and 24 may vary dependant on the amount of vacuum intended to be drawn. A vacuum may be better created in the toilet by sealing the lid of the water tank 13 using rubber gasket seals on the lid of the tank 13 and the bottom of the toilet seat mounted to the toilet bowl 12. Any additional spaces in the tank should also be sealed to facilitate vacuum suction.

The type vacuum motor that has proven to work well is a motor manufactured by United Electric, Inc., model #116309-00. The motor operates at 26,000 rotations per minute and has a draw of 63 inches of $H_2O$ vacuum. The motor may be modified to adjust its noise level and amount of draw; for example, a motor operating at approximately 15,000 to 16,000 rotations to pull a vacuum of approximately 1 to 2 inches at the bowl. This embodiment is relatively quiet and provides a sufficient draw to remove odors and aromas without over-inhibiting the flow of water during flushing. During construction of a building the vacuum motor 19 may be readily aligned with the sewage lines to the toilet 11 already present in the building frame. The vacuum motor 19 and conduit 23 is mounted in the ceiling in alignment with the sewage lines. When the drywall or sheetrock is secured to the frame it is marked to show placement of the vacuum motor 19 and conduit 23. Then when the toilet 11 is mounted in place, it is adapted with the conduit 24 and the hole is made for conduit 24 to extend into the wall void 21.

Figure 3:
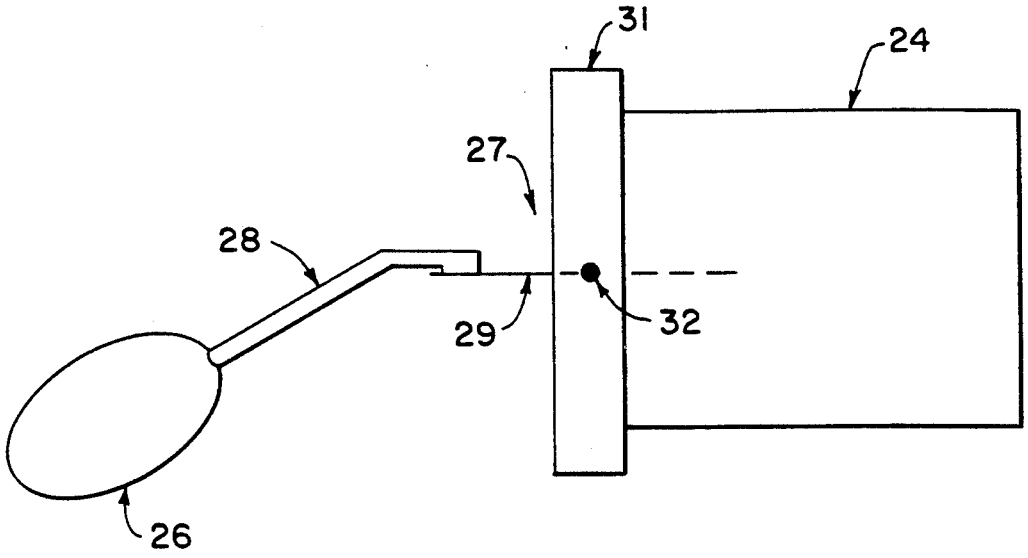
FIG. 3 is a side view of the shut-off valve.

A strong vacuum is required to work properly; and therefore may create an offset effect when the toilet 11 is flushed and water flows against the air flow. This invention utilizes a shut-off valve 27 pivotally mounted in conduit 24 adjacent to tank 13, shown in FIGS. 1, 2 and 3. One construction of this shut-off valve 27 includes a plate 29 and arm member 28 attached to the plate 29 that extends downward into the tank 13. The plate 29 and arm member 28 may be constructed of material used in the plumbing industry, such as brass or stainless steel. A floatable device 26, such as a styrofoam plug, is attached to the arm member 28 distal the plate 29. A pin 32 traverses the opening of the conduit 24 and the plate 29 is rotatably secured to the pin 32 to form a hinge-type mechanism. A flange section 31 may be placed on the conduit 24 to better secure the pin 32 in the conduit 24.

Figure 5:
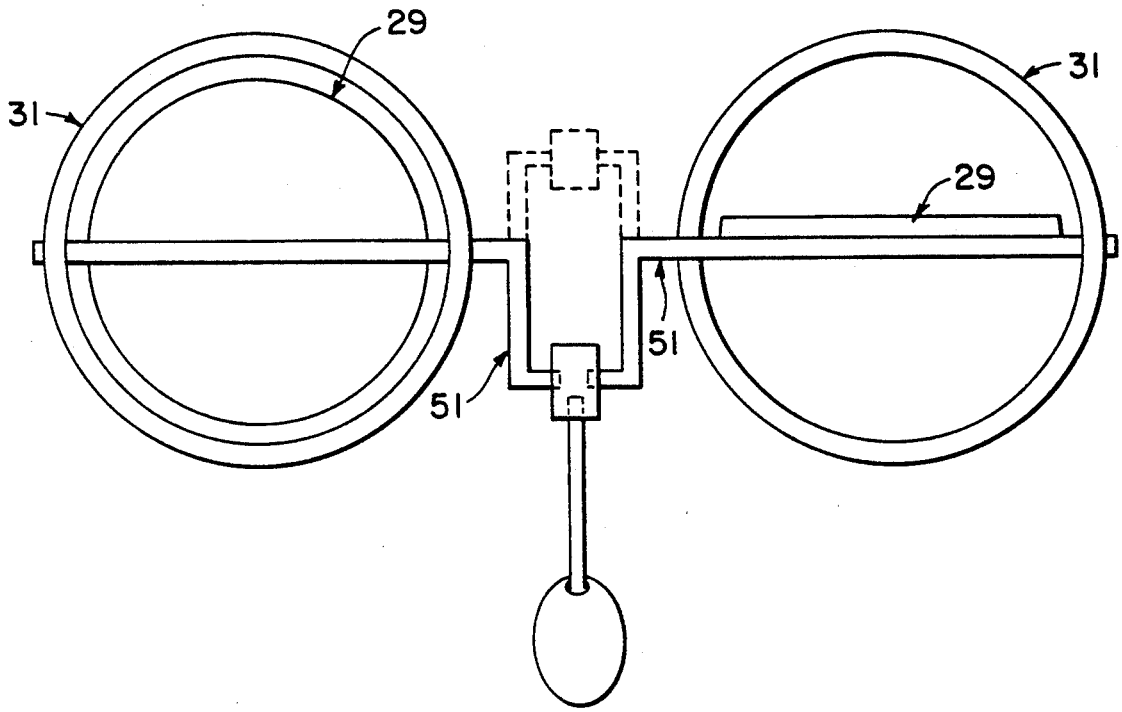
FIG. 5 is a front view of valves mounted in the tank.
Figure 6:
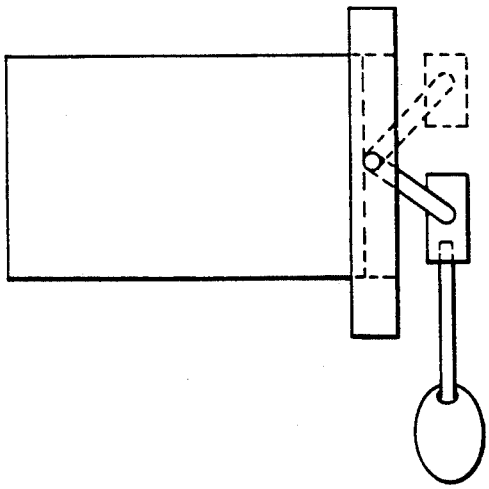
FIG. 6 is a side view of valves in FIG. 5.

During the flushing mode, as water level drops, this water flow from the tank 13 and into the bowl 12 creates a vacuum in the tank further inhibiting water flow. If the air flow from the vacuum motor 19 is too strong, it may be necessary to provide additional air in the tank 13 so water flow may not be further inhibited. A valve 48 may be mounted into the tank to act in opposition to the shut-off valve 27. The valve 48 is similar in construction to the shut-off valve 27 and is activated concomitantly with the raising of the water level in the tank. This valve 48 will be in a substantially vertical position when the water is at its highest level while valve 27 is in a horizontal position. As the water drops, the valve will open allowing air to be drawn from outside the tank 13. Note, the valves may be connected to the same floatable device so that the opening and closing of the valves is synchronized. As illustrated in FIGS. 5 and 6 one embodiment may involve the valves 48 and 27 approximately 4 inches apart. The back plate 29 in the valves has an L-shaped arm 51 extending intermediate the valves and is connected to a small coupling device 30. The arm 51 is fixed to the plates such that as one valve opens the other moves in a closed position. This way the movement of the valve is synchronized to provide relief in the tank during flushing and regulation of the air flow generated by the vacuum motor 19.

An aperture may be placed in the conduit 23 adjacent the vacuum motor to provide an alternative source of air to the vacuum. This provides air to the vacuum when the shut off valve seals the toilet from the vacuum draw. The size of the hole may vary depending on the amount of vacuum desirable to pull at the bowl. An aperture about ¾ inches in diameter has been found to work well with the size vacuum motor and tubing referenced above. This additional air allows the motor to operate more quietly during operation.

Figure 4:
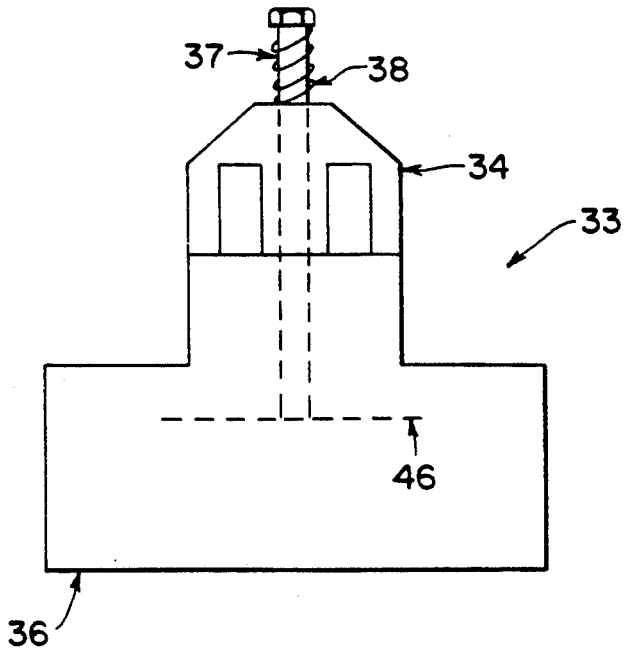
FIG. 4 is a side view of a relief valve.

Another embodiment may include a relief valve 33 mounted in the conduit 23 adjacent vacuum motor 19. As shown in FIGS. 4 and 5 the relief valve 33 may include a spring loaded adjustable relief valve that is activated when the shut-off valve 27 closes off the air flow to the vacuum motor 19. The spring loaded relief valve 33 may be adjustable to open a passage way for the vacuum to continue to draw air after the shut-off valve 27 has been activated to close off the source of air flow into the vacuum motor 19.

As illustrated in FIG. 4, the relief valve 33 is easily adaptable to the ventilation unit. A guide 34 is mounted to the top of a T-shape conduit 36. A bolt 37 is vertically secured in the guide 34 and a plate 46 is horizontally mounted to the bottom of the bolt 37. A spring 38 fits over the bolt 37 and is held on by the nut 47 so the tension in the spring 38 is adjustable by vertically adjusting the nut 47 on the bolt 43. As the shut-off valve 27 closes the source of air from the toilet 11, the vacuum eventually must draw air from an alternative source through the opening in the top of the T-shape conduit 36. The pull drawn from the vacuum motor 19 will activate the relief valve 33, pulling plate 44 down allowing the vacuum to draw air from the attic space 22 to prevent the vacuum motor 19 from burning out.

In operation of the invention, a user entering the bathroom may activate the vacuum motor 19. The vacuum motor 19 inducing air to flow out of the back of the water tank 13 and into the wall void 21 and eventually into the vacuum motor 19 mounted above the ceiling. During this air flow induction, the shut-off valve 27 is held in a substantially horizontal position to facilitate the air flow into the wall void 21. When the user flushes the toilet 11, the water flows into the bowl 12 through the water conduit 14 and water holes 16. In order to prevent the vacuum from inhibiting the water flow, the arm member 28 descends as the water level in the tank descends. When the shut-off valve 27 reaches a substantially vertical position, the air flow from the vacuum motor 19 is terminated so the water flow of the toilet 11 is no longer inhibited. To prevent the vacuum motor 19 from burning out the pressure release valve is activated to draw air from the attic space 22. Additionally as the water in the tank drops the valve 48 opens relieving any vacuum created by this drop in water level.

While we have shown our invention in one form, it will be obvious to those skilled in the art that it is not so limited but is susceptible of various changes and modifications without departing from the spirit thereof.

What I claim is:

1. A ventilation unit for a conventional toilet in a building to vent odors from said toilet to remote areas through wall voids in the building frame surrounding said toilet, said toilet having a bowl with a rim, a water tank, and an overflow tube in said water tank connected to a conduit in the rim of the bowl for passage of water and apertures in said rim for flow of water to enter the bowl, comprising:

a) means, adapted to be connected to the water tank, for inducing air flow through the overflow tube, rim and apertures of the toilet and away from said toilet to draw odors from the toilet; and b) means, mounted to said air inducing means, for regulating the air flow created by said air inducing means, including a first valve in communication with said air inducement means adjacent said water tank, said valve connected to a floatable device in the water such that the valve is actuated concomitantly with the lowering and raising of the water level of said water tank, to regulate the flow of air created by the air inducement means.

2. A ventilation unit as defined in claim 1 further including means for providing an air source, alternative to the tank, to the toilet when the first valve closes terminating communication between the toilet and air inducement means.

3. A toilet ventilation unit defined in claim 2 wherein said air inducement means includes a vacuum motor adapted to be connected to the water tank at a level above a maximum water line in said tank.

4. A ventilation unit as defined in claim 1 wherein said toilet ventilation unit further includes a second valve pivotally mounted in said tank to operate concomitantly with the raising and lowering of the water level and in opposition to said first valve wherein said second valve is actuated by an arm connected to a floatable device in the water connected to said second valve.

5. A toilet ventilation unit as defied in claim 1 wherein said air inducement means comprises:

(a) a vacuum motor adapted to be mounted int he ceiling of the building;

(b) a first conduit, connected to said vacuum motor, extending into a wall void behind the toilet; and (c) a second conduit adapted to be mounted in the tank of the toilet at a point above a maximum water line of said water tank and extending into the wall void behind the toilet.

6. A toilet ventilation unit as defined in claim 1 wherein said air inducement means comprises:

(a) vacuum motor mounted in the space above the ceiling;

(b) a conduit, connecting the vacuum motor to said water tank.

7. A ventilation unit as defined in claim 1 further including a means for automatically activating and deactivating the air inducement means in accordance with the lifting and lowering of the toilet lid respectively.

8. A ventilation unit for a conventional toilet having a water tank mounted to a bowl with a rim, and an overflow tube in said water tank connected to a conduit in the rim of the bowl for passage of water in apertures in said rim for flow of water to enter the bowl, comprising:

a) a vacuum motor adapted to be connected to the water tank by a conduit system to draw air out of the toilet via the overflow tube, rim and apertures of said toilet;

b) means, mounted in said conduit system, for terminating suction induced by said vacuum motor wherein said terminating means includes a valve connected to a device, floatable in the water of the toilet such that said valve is actuated responsive to the raising and lowering of the water level in the toilet; and c) A second valve mounted int he tank actuated by the raising and lowering of the water level int he tank in opposition to said first valve to relieve a vacuum created in the tank by a drop in the water level of said tank during flushing to allow free water flow.

9. A ventilation unit as defined in claim 8 further including a third valve adjacent to the vacuum motor in the conduit system, for providing an air source alternative to the tank after said first valve is actuated to terminate suction of the vacuum motor means to the toilet.

10. A ventilation unit for a conventional toilet having a water tank mounted to a bowl with a rim, and an overflow tube in said water tank connected to a conduit in the rim of the bowl for passage of water, and apertures in said rim for flow of water to enter the bowl, comprising;

a) a vacuum motor adapted to be connected to sad water tank, by a conduit, to induce air flow through said overflow tube, rim, and apertures and away from the toilet to draw odors from said toilet;

b) means for regulating air flow in and out of the water tank, including a first valve mounted in said conduit adjacent tot he water tank and connected to a device floatable in the water of said water tank such that said first valve is actuated concomitantly with the rising and lowering of the water level in the tank to regulate the flow induced out of the tank by the vacuum motor and a second valve adapted to be mounted to said water tank, and connected to said floatable device such that said second valve is actuated concomitantly with the raising and lowering of water in opposition to said first valve to regulate the air flow in to the tank.

* * * * *